US007431095B2

(12) United States Patent
Olson et al.

(10) Patent No.: US 7,431,095 B2
(45) Date of Patent: Oct. 7, 2008

(54) NON-TUBING DEPLOYED WELL ARTIFICIAL LIFT SYSTEM

(75) Inventors: David L. Olson, Los Alamitos, CA (US); Bruce Proctor, Tulsa, OK (US); Doug W. Berry, Broken Arrow, OK (US); Kelley L. Phillips, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 72 days.

(21) Appl. No.: 11/243,263

(22) Filed: Oct. 4, 2005

(65) Prior Publication Data

US 2007/0074871 A1 Apr. 5, 2007

(51) Int. Cl.
*F04B 35/01* (2006.01)

(52) U.S. Cl. ..... 166/378; 417/360

(58) Field of Classification Search ..... 166/378, 166/382, 386, 105, 107, 369, 242.6; 417/360
See application file for complete search history.

(56) References Cited

U.S. PATENT DOCUMENTS

| | | | | | |
|---|---|---|---|---|---|
| 2,456,227 | A | * | 12/1948 | Wade | 418/48 |
| 3,369,715 | A | | 2/1968 | Carter | 222/333 |
| 3,411,454 | A | | 11/1968 | Arutnoff | 103/219 |
| 3,672,795 | A | | 6/1972 | Arutunoff et al. | 417/424 |
| 3,853,430 | A | | 12/1974 | O'Rourke | 417/360 |
| 4,171,934 | A | * | 10/1979 | Zehren | 417/360 |
| 4,363,359 | A | | 12/1982 | Taylor et al. | 166/214 |
| 4,621,689 | A | | 11/1986 | Brookbank, III | 166/106 |
| 4,723,890 | A | | 2/1988 | Corteville et al. | 417/151 |
| 4,749,341 | A | * | 6/1988 | Bayh, III | 417/360 |
| 4,928,771 | A | | 5/1990 | Vandevier | 166/385 |
| 5,209,294 | A | * | 5/1993 | Weber | 166/105 |
| 5,725,053 | A | * | 3/1998 | Weber | 166/105 |
| 5,988,992 | A | * | 11/1999 | Tetzlaff et al. | 417/360 |
| 6,089,832 | A | * | 7/2000 | Patterson | 417/360 |
| 6,193,474 | B1 | * | 2/2001 | Tetzlaff | 417/360 |
| 6,338,388 | B1 | * | 1/2002 | Winkler | 166/382 |
| 6,398,583 | B1 | | 6/2002 | Zehran | 439/576 |
| 6,695,060 | B1 | * | 2/2004 | Guidry et al. | 166/370 |
| 6,729,391 | B2 | * | 5/2004 | Hill et al. | 166/68.5 |
| 7,201,222 | B2 | * | 4/2007 | Kanady et al. | 166/68 |
| 2003/0111221 | A1 | * | 6/2003 | Hill et al. | 166/68.5 |
| 2007/0079970 | A1 | * | 4/2007 | Belcher et al. | 166/369 |

* cited by examiner

*Primary Examiner*—Jennifer H Gay
*Assistant Examiner*—Daniel P Stephenson
(74) *Attorney, Agent, or Firm*—Fellers, Snider, Blankenship, Bailey & Tippens

(57) ABSTRACT

A progressing cavity pump (PCP) system that may be deployed in an existing well configuration without the need for a workover rig. A stator and tubing stop are first set in a conduit, such as production tubing, at a desired depth. In subsequent wireline runs, a pack-off and upper tubing stop are installed above the stator, which results in the stator assembly being set by tubing stops on top and bottom and results in the conduit above the PCP being isolated from the wellbore below. Installation of the system is completed by installing the rotor and by installing top-side drive equipment in the usual way. The PCP system allows the deployment of lift systems within existing well configurations without any element being deployed on tubing and provides the ability to retrofit a well with an insertable pump within existing tubing.

8 Claims, 2 Drawing Sheets

NON-TUBING DEPLOYED WELL ARTIFICIAL LIFT SYSTEM

FIELD OF THE INVENTION

This invention relates generally to submersible well pumps, and in particular to a progressive cavity pump for installation in existing well conduits.

BACKGROUND OF THE INVENTION

Common artificial lift systems utilize a system element that is deployed on tubing. For example, electrical submersible systems are deployed or at least partially deployed on tubing. Stators for top-driven progressing cavity pump systems are deployed on tubing. Insertable progressing cavity pumps or reciprocating pumps have tubing deployed seating nipples. Gas lift uses tubing deployed mandrels, etc.

For deep wells, electrical submersible well pumps are typically installed within casing on a string of tubing. The tubing string may be made up of sections of pipe that are screwed together. A motor suspended by the tubing may be supplied with power through a power cable that is strapped alongside the tubing. A pump is normally located above the motor and is connected to the lower end of the tubing. The pump forces fluid through the tubing to the surface.

A centrifugal pump is normally utilized for large pumping volume requirements. The centrifugal pump typically has a large number of stages for moving fluid. In a conventional arrangement, once a centrifugal pump has failed, a costly workover is required wherein the centrifugal pump is retrieved by raising the tubing on which it is suspended.

Another kind of submersible pump is referred to as a progressing cavity pump or PCP. A PCP is suitable for lesser pumping volume requirements or where significant quantities of solids, such as sand and scale, are likely to be encountered. PCPs typically utilize an elastomeric stator defining double helical cavities. The elastomeric stator receives a helical rotor that is rotated therein. The helical rotor may be rotated by a motor located on the surface via a rod that extends down to the pump in the well. Alternatively, the helical rotor may be rotated by a motor lowered into the well with the PCP in an arrangement similar to that of a submersible centrifugal pump.

Another kind of surface-driven PCP installation is known as an insertable PCP. In this type of installation, the pump, stator and rotor are deployed together on rods through the tubing to engage a seating nipple in the tubing string. The rod string is manipulated after seating to free the rotor for normal operation.

When used in harsh environments, it is not uncommon for a PCP to lock-up if the PCP is unable to remove solids that enter the pump. Lock-up can also occur if the pump assembly is shut down since solids in the tubing string tend to settle back down on top of the pump. When pump lock-up occurs in a standard surface-driven PC application, the rod string is pulled from the well with the attached pump rotor. The tubing and pump stator are then flushed and circulated. Once the tubing and pump stator are clean, the pump rotor is lowered on the rod string and reinstalled into the pump stator. The same conditions that lock-up surface driven applications also apply to the bottom drive systems.

One drawback associated with a PCP installed in a conventional PCP arrangement is that a PCP stator may not be removed without performing a costly workover. Further, since the PCP stator is typically deployed on the tubing string, the stator may not be relocated without manipulating the tubing string.

To facilitate deployment of various lift systems within existing well configurations it is desirable to be able to deploy any element without deploying the element on tubing. For example, it is desirable to be able to install PCP equipment using commercially available wireline tooling.

Additionally, it is desirable to be able to relocate a pump within a well in an efficient and low cost manner.

SUMMARY OF THE INVENTION

One embodiment of this invention is a top-driven progressing cavity pump (PCP) that may be deployed in an existing well without requiring the well operator to use a workover rig to install an alternative lift system. To deploy the PCP of the invention, a stator is set in a conduit, such as production tubing, at a desired depth. Installation is then continued in the normal way.

The PCP of the preferred embodiment utilizes a stator provided with a tag bar nipple and a no-turn tool attached to the bottom of the stator. To set the stator in the existing tubing, a tubing stop is attached to the no-turn tool and a centralizer/receptacle is attached to the top of the stator. The stator and attached equipment are then lowered into the well on commercially available wireline tooling. At the desired setting depth the wireline is sharply braked to activate a lower tubing anchor or tubing stop. The lower tubing stop is designed so that the lower stop will not allow downward movement, but may be drawn upward.

In subsequent wireline runs, a pack-off and upper tubing stop are inserted into the top of a centralizer/receptacle attached to the top of the stator. As a result, the stator assembly is set by tubing stops on top and bottom, wherein the tubing above the PCP is isolated from the wellbore below. Installation of the system is completed by installing the rotor, e.g. on rods, and by installing top-side drive equipment in the usual way.

DESCRIPTION OF THE PREFERRED EMBODIMENTS

Before explaining the present invention in detail, it is important to understand that the invention is not limited in its application to the details of the embodiments and steps described herein. The invention is capable of other embodiments and of being practiced or carried out in a variety of ways. It is to be understood that the phraseology and terminology employed herein is for the purpose of description and not of limitation.

Progressing cavity pump (PCP) system 10 is shown located in a well. The PCP system 10 of the invention is suitable for placement in an existing conduit 12, e.g. existing tubing string 14 as shown in FIG. 1. Tubing string 14 is shown located within well casing 16 in FIG. 1.

Figure 1A:
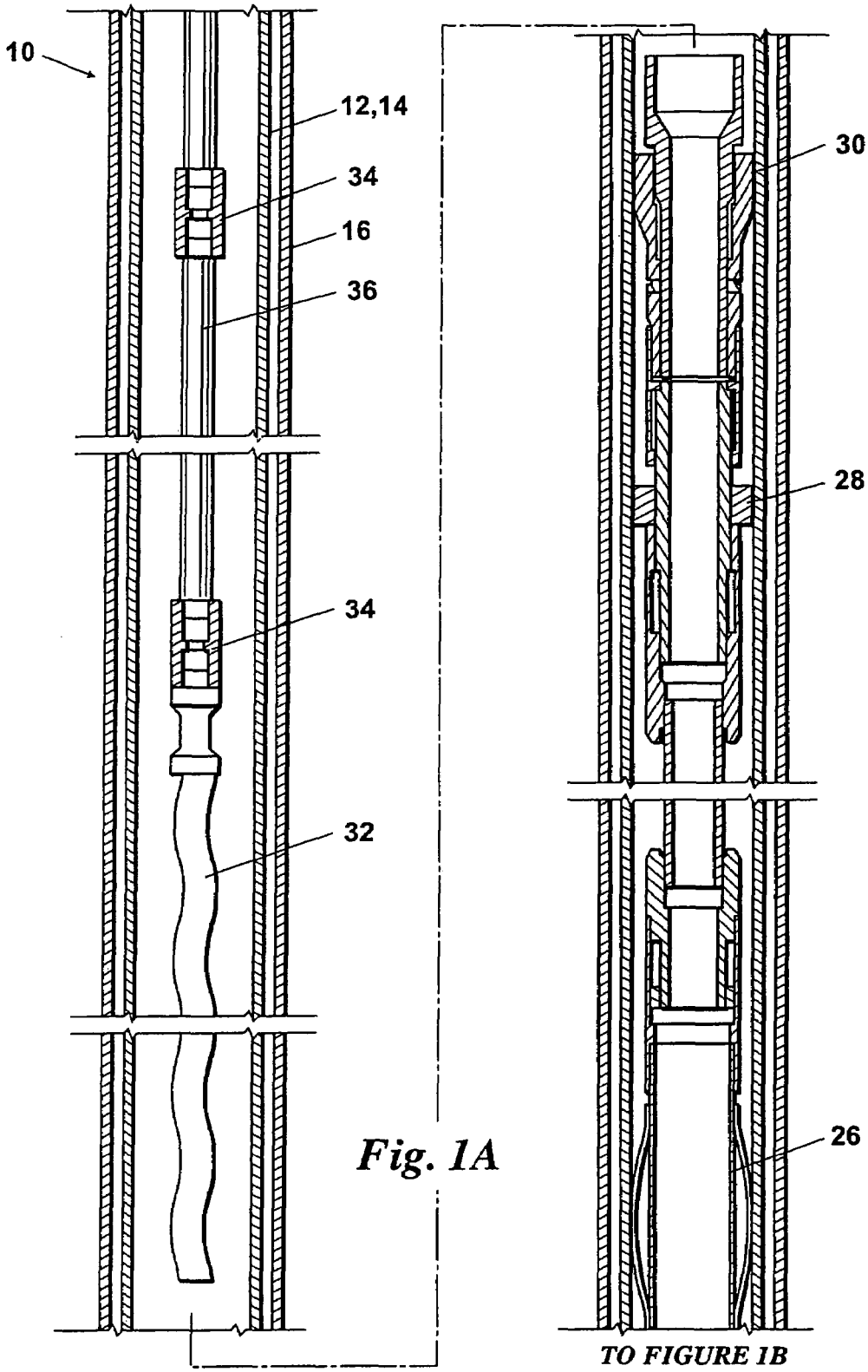
FIG. 1A shows a schematic view of a portion of the PCP system of the invention installed in existing tubing and a rotor being lowered for installation therein.
Figure 1B:
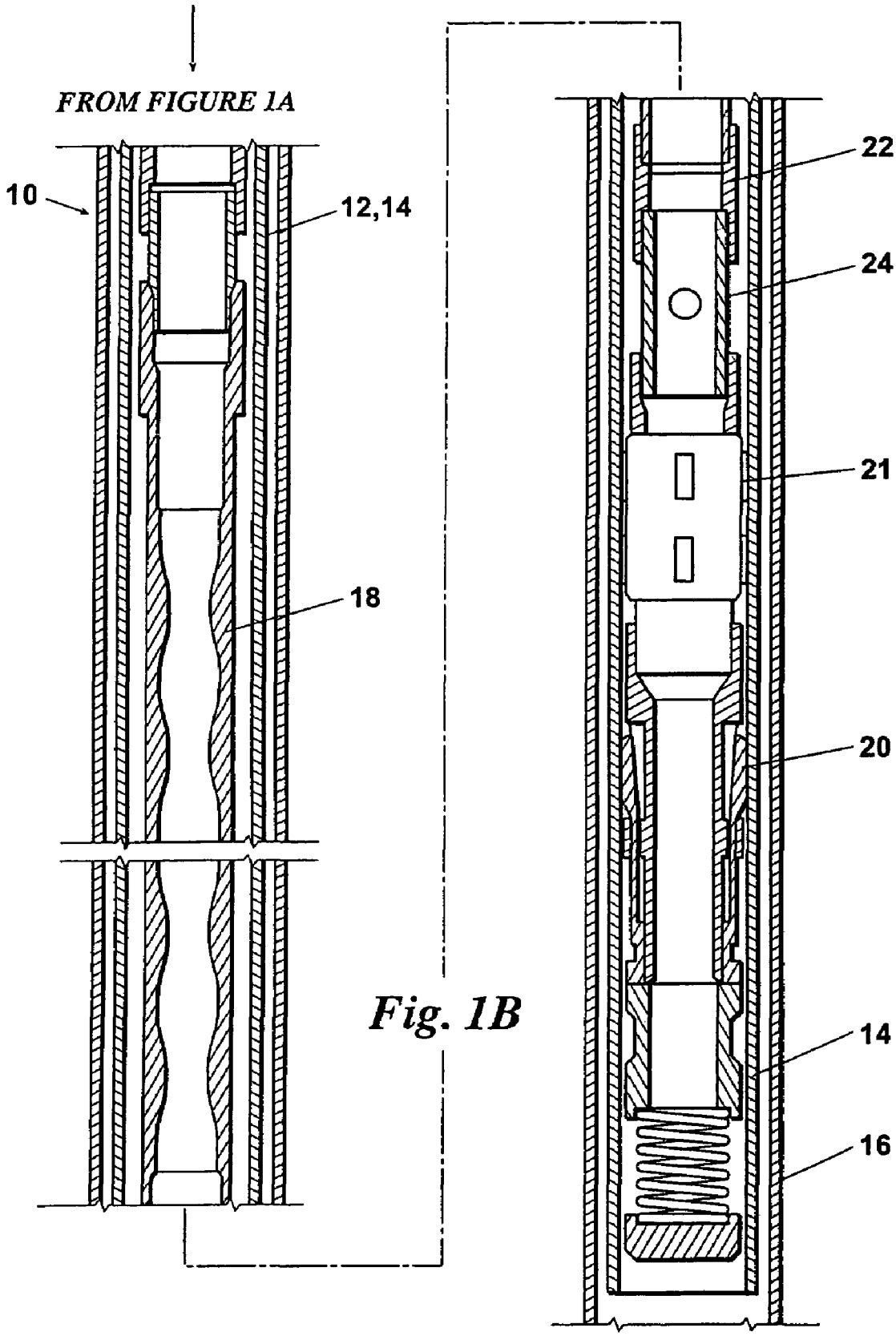
FIG. 1B shows a schematic view of a portion of the PCP system of the invention installed in existing tubing.

Referring now to FIG. 1B, a lower tubing stop 20 is affixed to a no-turn tool 21. No-turn tool 21 is affixed to tag bar 24, which is threadably connected to stator 18 via collar 22.

Lower tubing stop 20 is provided for engaging conduit 12. A centralizer/receptacle 26 (FIG. 1A) is affixed to an upper end of stator 18. Pack-off 28 (FIG. 1A) is positioned within conduit 12 above stator 18. Upper tubing stop 30 is provided above pack-off 28.

Referring now to FIG. 1A, rotor 32 may be lowered within conduit 12 for locating within stator 18. Rotor 32 preferably has a rotor coupling 34 on an upper end thereof. Rotor coupling 34 is provided for removable connection to sucker rod string 36 so that rotor 32 may be lowered within conduit 12.

Lower tubing stop 20 and upper tubing stop 30 preferably carry a plurality of slips each having a gripping surface. The slips may be manipulated to selectively engage the gripping surface with an inner surface of conduit 12.

In practice, stator 18 is lowered into conduit 12, such as production tubing 14, to a desired depth. Stator 18 is set in conduit 12 with lower tubing stop 20, which is attached below pump stator 18. Centralizer/receptacle 26 is preferably attached to the top of stator 18 for receiving equipment in subsequent wireline runs. Stator 18 and attached equipment are then run in conduit 12, preferably by wireline although system components may also be deployed by sucker rod. At a desired setting depth, the wireline or sucker rod is sharply braked to force gripping surfaces of lower tubing stop 20 outwardly into contact with the inner wall of conduit 12. Lower tubing stop 20 is designed such that the lower tubing stop 20 will not allow downward movement but will allow the lower tubing stop 20 to be drawn upward, thereby allowing retrieval of the stator assembly at some future time or upward adjustment of the position of stator 18.

In subsequent wireline or sucker rod runs, pack-off 28 and upper tubing stop 30 are inserted into a centralizer/receptacle 26 on top of stator 18. The result is that stator 18 is set at top and bottom by tubing stops 20, 30 and that conduit above PCP system 10 is isolated from the wellbore below. Installation of PCP system 10 may then be completed by installing PC pump rotor 32 on rods 36 and top-side drive equipment in a manner known in the art.

Advantages of the PCP system of the invention include the ability to deploy various lift systems within existing well configurations. Additionally, the PCP system of the invention may be deployed without requiring the deployment of any element on tubing. Further, the PCP system may be relocated within a well without requiring a well workover. The above-referenced advantages result in significant time and cost savings when deploying pumping systems in existing wells.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A well, comprising:

an existing conduit extending downwardly from a surface;

a tubing stop for selective engagement with said existing conduit;

a progressing cavity pump stator attached to said tubing stop and adapted to be lowered with said tubing stop into said conduit and set in said conduit at a selected depth;

a rotor for deployment within said conduit for locating within said progressing cavity pump stator; and an upper tubing stop and pack-off adapted to be lowered into said conduit and set above said progressing cavity pump stator in said conduit.

2. A method for deploying a progressing cavity pump comprising the steps of:

lowering a progressing cavity pump stator and attached lower tubing stop into an existing conduit in a well on wireline;

securing said progressing cavity pump stator within said conduit with said attached lower tubing stop;

lowering a pack-off and upper tubing stop into said existing conduit on wireline;

setting said upper tubing stop above said progressing cavity pump stator in said conduit; and deploying a rotor within said conduit and inserting said rotor within said stator.

3. The method according to claim 2 wherein:

said step of securing said progressing cavity pump stator within said conduit comprises securing said stator to tubing.

4. The method according to claim 2 wherein:

said step of deploying a rotor comprises lowering said rotor on sucker rods.

5. A method of repositioning a progressing cavity pump within a well conduit comprising the steps of:

disengaging gripping surfaces of tubing stops for contact with an inner surface of the conduit;

releasing engagement of said tubing stops with the conduit;

relocating a progressing cavity pump affixed to said tubing stops within said conduit;

engaging said gripping surfaces of said tubing stops with said inner surface of said conduit for securing the progressing cavity pump within said conduit at a desired location.

6. A method for deploying a progressing cavity pump comprising the steps of:

lowering a progressing cavity pump stator and attached lower tubing stop into an existing conduit in a well on sucker rod or wireline;

securing said progressing cavity pump stator within said conduit with said attached lower tubing stop;

lowering a pack-off and upper tubing stop into said existing conduit on sucker rod or wireline;

setting said upper tubing stop above said progressing cavity pump stator in said conduit; and deploying a rotor within said conduit and inserting said rotor within said stator.

7. The method according to claim 6 wherein:

said step of securing said progressing cavity pump stator within said conduit comprises securing said stator to tubing.

8. The method according to claim 6 wherein: said step of deploying a rotor comprises lowering said rotor on sucker rods.

* * * * *